US007137364B2

(12) United States Patent
Takahashi

(10) Patent No.: US 7,137,364 B2
(45) Date of Patent: Nov. 21, 2006

(54) COOLING SYSTEM OF ENGINE FOR PERSONAL WATERCRAFT

(75) Inventor: Keiji Takahashi, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 11/165,826

(22) Filed: Jun. 24, 2005

(65) Prior Publication Data

US 2006/0000430 A1 Jan. 5, 2006

(30) Foreign Application Priority Data

Jun. 24, 2004 (JP) ..... 2004-185918

(51) Int. Cl.
*F01P 7/14* (2006.01)
*F01P 1/06* (2006.01)

(52) U.S. Cl. ..... 123/41.72; 123/41.08; 123/41.31

(58) Field of Classification Search ..... 123/41.72, 123/41.08, 41.31, 41.1, 41.01, 88 R
See application file for complete search history.

(56) References Cited

U.S. PATENT DOCUMENTS 3,358,654 A * 12/1967 Shanahan et al. ..... 123/41.08
4,588,385 A * 5/1986 Suzuki et al. ..... 440/88 R

FOREIGN PATENT DOCUMENTS

JP HEI4-334720 11/1992

* cited by examiner

*Primary Examiner*—Stephen K. Cronin
*Assistant Examiner*—Hyder Ali
(74) *Attorney, Agent, or Firm*—Alleman Hall McCoy Russell & Tuttle LLP.

(57) ABSTRACT

An open-looped cooling system is disclosed. The cooling system typically includes a cylinder head including a first water jacket through which cooling water flows, a cooling water inlet through which the first water jacket communicates with outside, and a first cooling water outlet through which the first water jacket communicates with outside, a cylinder block including a second water jacket through which the cooling water within the first water jacket flows, the second water jacket being configured to communicate with the first water jacket, and a second cooling water outlet through which the second water jacket communicates with outside, and a thermostat configured to control a flow rate of the cooling water flowing out from the second cooling water outlet of the cylinder block based on a temperature of the cooling water.

6 Claims, 6 Drawing Sheets

COOLING SYSTEM OF ENGINE FOR PERSONAL WATERCRAFT

BACKGROUND OF THE INVENTION

1. Field of the Invention

The present invention generally relates to a cooling system of an engine for personal watercraft. More particularly, the present invention relates to a cooling system which is capable of inhibiting excess cooling of a cylinder block of an engine.

2. Description of the Related Art

In recent years, water-jet propulsion personal watercraft have been widely used in leisure, sport, rescue activities, and the like. A typical personal watercraft comprises a body including a hull and a deck covering the hull from above, and is equipped with an engine in a space inside the watercraft that is defined by the hull and the deck. The engine is configured to drive a water jet pump configured to propel the watercraft, which pressurizes and accelerates water sucked through a water passage from a water intake generally provided on a hull bottom surface and ejects it rearward from an outlet port. As a result, the personal watercraft is propelled.

In such a personal watercraft, typically, water, for example, sea or lake water that has been pressurized by the water jet pump is partially drawn up from an inside of the water jet pump through a water-drawing hole formed in a pump casing of the water jet pump, for use as cooling water to cool various engine components. The cooling water flows through a cylinder head, a cylinder block, and auxiliary devices such as an exhaust pipe (e.g., exhaust manifold) while cooling these components. Such a cooling system is referred to as an open-looped cooling system (direct cooling system). In the personal watercraft disclosed in Japanese Patent No. 3084781, water is taken in from outside the watercraft for use as cooling water and is supplied to a passage formed in a wall portion of an exhaust manifold, and some of the cooling water flows through a passage formed within a wall portion of a cylinder block and then through a passage formed within a wall portion of a cylinder head while cooling the engine components. After that, the cooling water is discharged outside the watercraft.

Since the exhaust pipe and the cylinder head tend to heat up to relatively high temperatures, they must be sufficiently cooled. On the other hand, if the cylinder block is cooled excessively, then a friction loss may increase between a piston that slides within the cylinder block and an inner wall of the cylinder block, and further, fuel existing within a combustion chamber may not be sufficiently vaporized, and the unvaporized fuel may flow into lubricating oil, leading to dilution of the oil.

In the personal watercraft which employs the above mentioned open-looped cooling system, the water used as cooling water, which is generally sea or lake water, typically has a relatively low temperature, and thus the cylinder block tends to be cooled excessively, if the engine runs at a low engine speed during, for example, an idling state in which heat generation amount is small.

In the cooling system disclosed in the above patent Japanese Patent No. 3084781, a thermostat is equipped to control a flow rate of the cooling water supplied to the engine components to inhibit excess cooling of the engine. In this cooling system, however, since the thermostat is positioned downstream of a point at which the cooling water that has cooled the cylinder head and the cooling water that has cooled the cylinder block gather, the flow rate of the cooling water to be supplied to the cylinder head may be reduced if the thermostat operates to inhibit excess cooling of the cylinder block. As a result, the cylinder head may be undesirably cooled insufficiently.

SUMMARY OF THE INVENTION

The present invention addresses the above described conditions, and an object of the present invention is to provide a cooling system of an engine for a personal watercraft, that is capable of inhibiting excess cooling of a cylinder block while appropriately cooling a cylinder head.

According to the present invention, there is provided a cooling system of an engine for a personal watercraft, the cooling system being an open-looped cooling system configured to take in water from outside the watercraft for use as cooling water to directly cool the engine, the cooling system comprising a cylinder head including a first water jacket through which the cooling water flows, a cooling water inlet through which the first water jacket communicates with outside, and a first cooling water outlet through which the first water jacket communicates with outside; a cylinder block including a second water jacket through which the cooling water within the first water jacket flows, the second water jacket being configured to communicate with the first water jacket, and a second cooling water outlet through which the second water jacket communicates with outside; and a thermostat configured to control a flow rate of the cooling water flowing out from the second cooling water outlet of the cylinder block based on a temperature of the cooling water.

In such a cooling system, the cooling water flowing through the cooling water inlet of the cylinder head is first supplied to the first water jacket of the cylinder head to cool the cylinder head, and then some of the cooling water is supplied to the second water jacket of the cylinder block to cool the cylinder block. Thereafter, the cooling water flows out from the first cooling water outlet of the cylinder head and the second cooling water outlet of the cylinder block. The thermostat controls the flow rate of the cooling water flowing out from the second cooling water outlet according to the temperature of the cooling water. When the thermostat operates to reduce the flow rate of the cooling water flowing out from the second cooling water outlet according to the temperature of the cooling water, the flow rate of the cooling water supplied to the second water jacket is reduced, while sufficiently supplying the cooling water to the first water jacket leading to the first cooling water outlet. As a result, excess cooling of the cylinder block is inhibited while sufficiently cooling the cylinder head. In addition, the thermostat is configured to operate properly based on the temperature of the cooling water flowing out from the second cooling water outlet of the cylinder block in order to inhibit excess cooling of the cylinder block. The thermostat may detect the temperature of the cooling water that has flowed out from the second cooling water outlet, or otherwise the cooling water that is going to flow out from the second cooling water outlet, i.e., the cooling water within the second water jacket.

The thermostat may be mounted to the cylinder block provided with the second cooling water outlet such that the cooling water within the second water jacket flows out through the thermostat and the second cooling outlet. In such a construction, since the thermostat operates based on the temperature of the cooling water which has just cooled the cylinder block or the temperature of the cooling water being cooling the cylinder block, the flow rate of the cooling water is properly controlled.

The thermostat may include a housing and an operating portion housed in the housing. The housing may include a tubular portion having an outer opening end and configured to be integral with a wall portion of the cylinder block such that an inside of the tubular portion communicate with the second water jacket of the cylinder block; and a lid portion configured to cover the outer opening end of the tubular portion.

The lid portion may be provided with the second cooling water outlet of the cylinder block.

The cooling system may further comprise an exhaust pipe that has a water jacket through which the cooling water flows and is connected to the cylinder head. The cooling water inlet of the cylinder head may be configured to open in a connecting end face between the cylinder head and the exhaust pipe, and may be configured to communicate with the water jacket of the exhaust pipe through the connecting face. In such a construction, since the cylinder block is cooled using cooling water that has increased in temperature by heat exchange with the exhaust pipe, which tends to be elevated in temperature, excess cooling of the cylinder block is inhibited.

The exhaust pipe may include a water muffler to which the cooling water is supplied to reduce an energy of an exhaust gas flowing therein. The second cooling water outlet may be provided in a wall portion of the cylinder block which is located on an exhaust port side of the engine. The cooling system may further comprise a cooling water pipe constructed such that one end portion thereof is connected to the second cooling water outlet of the cylinder block and an opposite end portion thereof is connected to a region of the exhaust pipe which is located upstream of the water muffler in a flow of the exhaust gas and is configured to communicate with an exhaust gas passage formed within the exhaust pipe. In such a construction, the second cooling water outlet is located near the exhaust pipe. Therefore, by configuring the cooling system such that the cooling water that has cooled the cylinder block is supplied to the water muffler of the exhaust pipe, the cooling water pipe connecting the second cooling water outlet to the exhaust pipe can be reduced in length and its piping is easily carried out.

The above and further objects and features of the invention will more fully be apparent from the following detailed description with accompanying drawings.

DETAILED DESCRIPTION OF THE PREFERRED EMBODIMENTS

Figure 1:
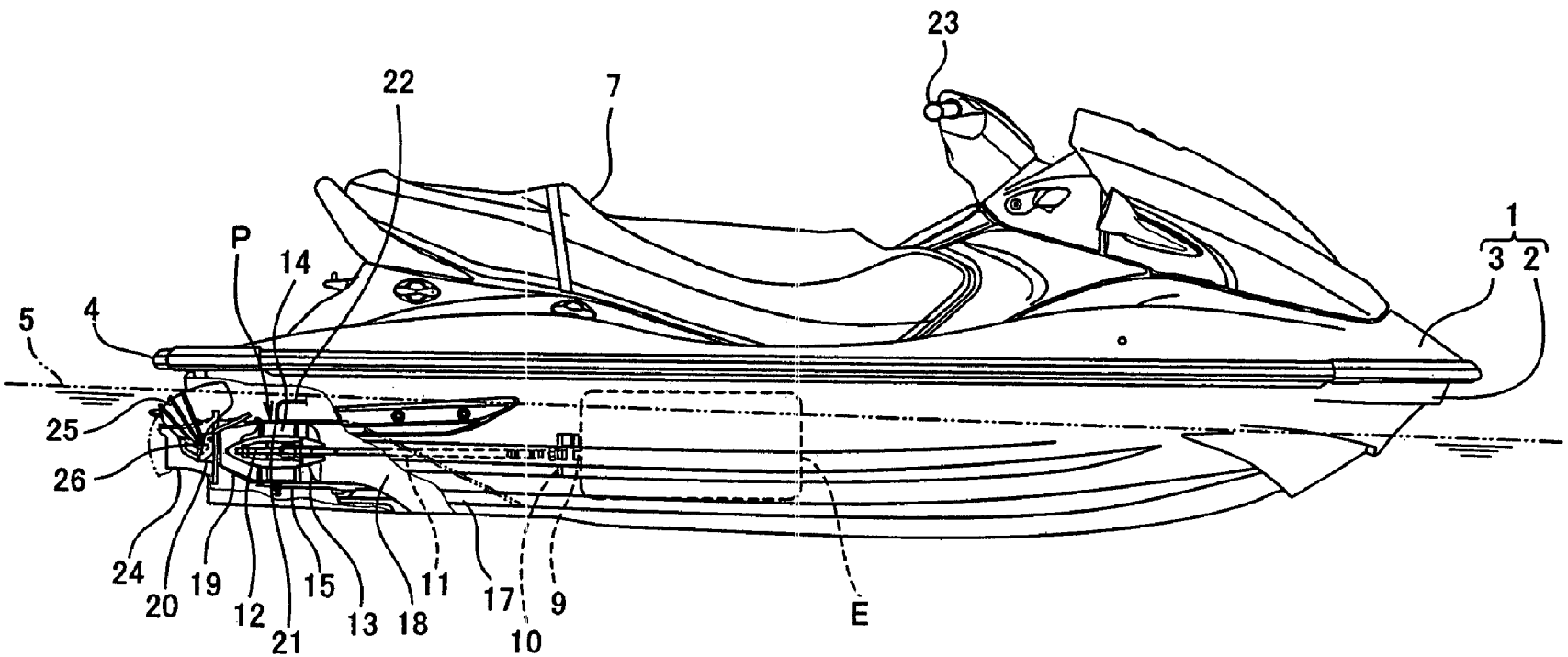
FIG. 1 is a side view of a personal watercraft according to an embodiment of the present invention, part of which is cut away to show a propulsion water jet pump.

Hereinafter, an embodiment of a cooling system of an engine for a personal watercraft of the present invention will be described with reference to the accompanying drawings. FIG. 1 is a side view of a personal watercraft according to an embodiment of the present invention, part of which is cut away to show a propulsion water jet pump P. The personal watercraft in FIG. 1 is a straddle-type personal watercraft equipped with a seat 7 straddled by a rider. A body 1 of the watercraft includes a hull 2 and a deck 3 covering the hull 2 from above. A line at which the hull 2 and the deck 3 are connected over the entire perimeter thereof is called a gunnel line 4. In FIG. 1, the gunnel line 4 is located above a waterline 5 of the personal watercraft.

Figure 2:
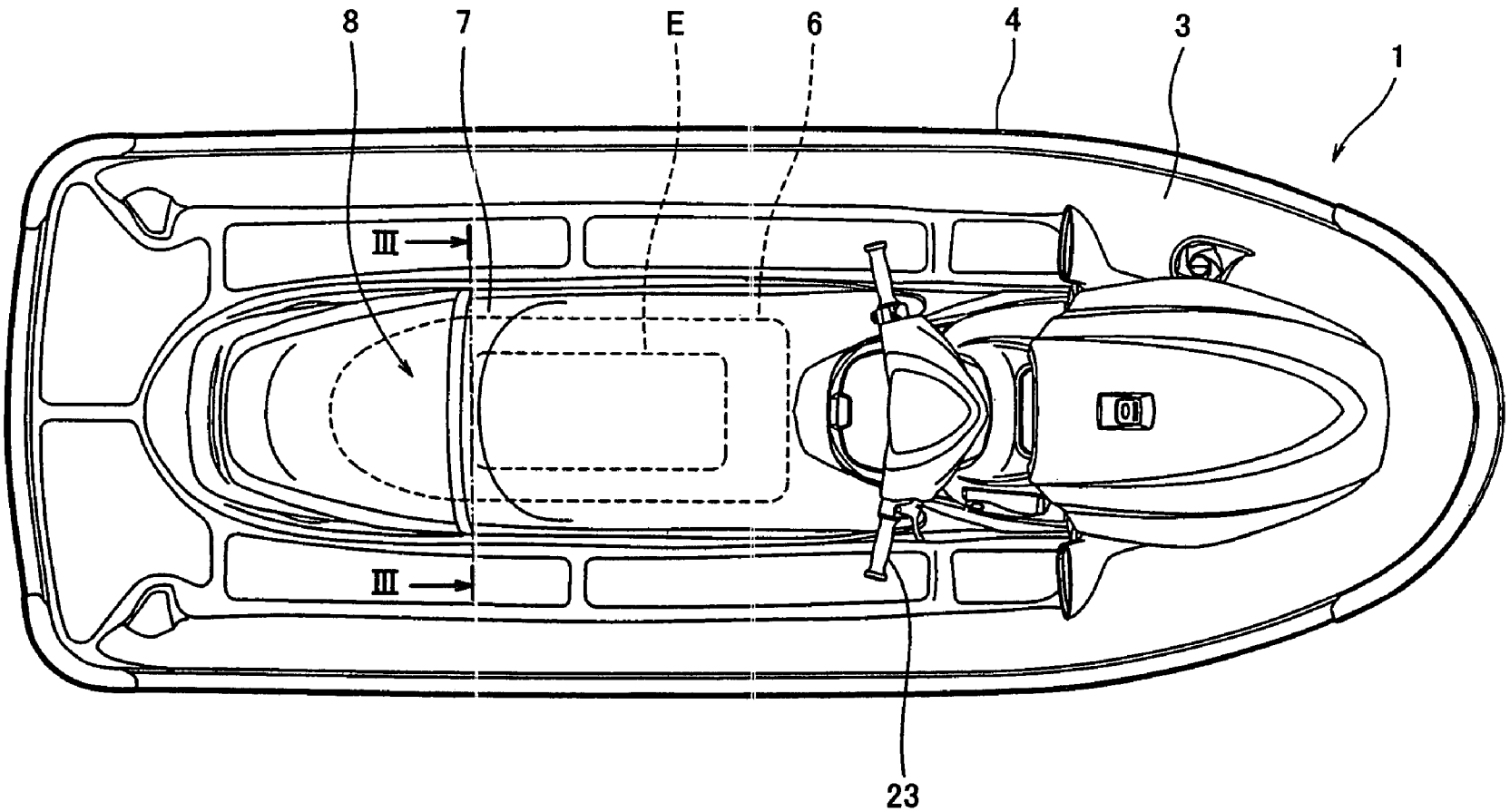
FIG. 2 is a plan view of the personal watercraft of FIG. 1.

As shown in FIG. 2, a deck opening 6, which has a substantially rectangular shape as seen from above is formed at a substantially center section of the deck 3 in the upper portion of the body 1 such that its longitudinal direction corresponds with the longitudinal direction of the body 1. The seat 7 is removably mounted over the deck opening 6. An engine room 8 is provided in a space defined by the hull 2 and the deck 3 below the deck opening 6. The engine room 8 has a convex-shaped transverse cross-section and is configured such that its upper portion is smaller than its lower portion. An engine E is mounted within the engine room 8 and configured to drive the watercraft. In this embodiment, the engine E is an in-line four-cylinder four-cycle engine. As shown in FIG. 1, the engine E is mounted such that a crankshaft 9 extends along the longitudinal direction of the body 1.

An output end of the crankshaft 9 is coupled to a propeller shaft 11 through a coupling device 10. The propeller shaft 11 is coupled to a pump shaft 12 of the water jet pump P mounted on the rear side of the body 1. The pump shaft 12 is configured to rotate integrally with the crankshaft 9. An impeller 13 is attached on the pump shaft 12. Fairing vanes 14 are provided behind the impeller 13. The impeller 13 is covered with a tubular pump casing 15 on the outer periphery thereof.

A water intake 17 is provided on the bottom of the body 1. The water intake 17 is connected to the pump casing 15 through a water passage 18. The pump casing 15 is connected to a pump nozzle 19 provided on the rear side of the body 1. The pump nozzle 19 has a cross-sectional area that gradually reduces rearward, and an outlet port 20 is provided on the rear end of the pump nozzle 19.

Water outside the watercraft is sucked from the water intake 17 provided on the bottom of the hull 2 and is fed to the water jet pump P. The water jet pump P pressurizes and accelerates the water, and the fairing vanes 14 guide water flow behind the impeller 13. The water is ejected through the pump nozzle 19 and from the outlet port 20 and, as the resulting reaction, the watercraft obtains a propulsion force.

The engine E employs an open-looped cooling system configured to directly cool the engine E or the like using the water taken in from outside for use as the cooling water. As shown in FIG. 1, a water-drawing hole 21 is formed at a predetermined position in an upper portion of the pump casing 15. The water that has been pressurized by the water jet pump P is drawn up into the body 1 through the water-drawing hole 21 and a cooling water pipe 22, and is used as the cooling water to cool the engine E and other components. A detailed construction of the cooling system of the engine E will be described later with reference to FIGS. 5 and 6.

A bar-type steering handle 23 is provided on the deck 3 to be located in front of the seat 7. The handle 23 is connected to a steering nozzle 24 provided behind the pump nozzle 19 through a cable (not shown). When the rider rotates the handle 23 clockwise or counterclockwise, the steering nozzle 24 pivots toward the opposite direction so that the ejection direction of the water being ejected through the pump nozzle 19 can be changed, and the watercraft can be correspondingly turned to any desired direction while the water jet pump P is generating the propulsion force.

As shown in FIG. 1, a bowl-shaped reverse deflector 25 is provided on the rear side of the body 1 and on an upper portion of the steering nozzle 24 such that it is vertically pivotable around a pivot shaft 26 that is oriented horizontally. When the deflector 25 is pivoted downward around the pivot shaft 26 to be positioned behind the steering nozzle 24, the water ejected from the steering nozzle 24 collides against an inner surface of the deflector 25 and is thereby directed substantially forward. As a result, the watercraft is propelled rearward.

Figure 3:
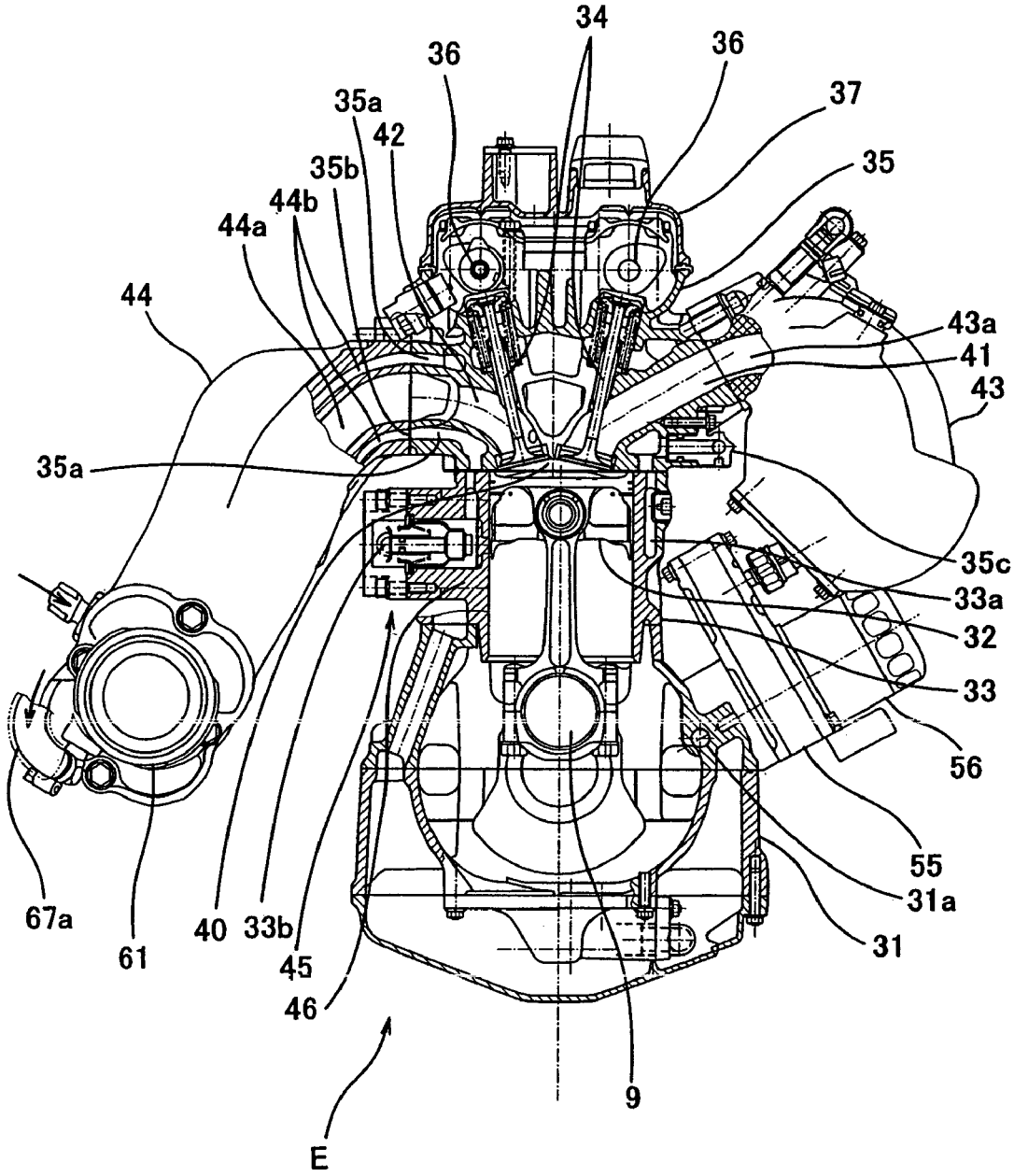
FIG. 3 is a partial cross-sectional view taken along line III—III of the personal watercraft of FIG. 2, showing an engine as viewed from the rear.

FIG. 3 is a partial cross-sectional view taken along line III-III of the personal watercraft of FIG. 2, showing the engine E as viewed from the rear. As shown in FIG. 3, the engine E includes, as major components, a crankcase 31 configured to accommodate the crankshaft 9, a cylinder block 33 connected to an upper portion of the crankcase 31 and configured to accommodate a piston 32, a cylinder head 35 connected to an upper portion of the cylinder block 33 and configured to accommodate air-intake and exhaust valves 34, and a cylinder head cover 37 connected to an upper portion of the cylinder head 35 and configured to accommodate camshafts 36 that drive the air-intake valves 34.

A space defined by the cylinder head 35, the cylinder block 33, and the piston 32 forms a combustion chamber 40. The cylinder head 35 is provided with an air-intake port 41 extending to the right from the combustion chamber 40 and an exhaust port 42 extending to the left from the combustion chamber 40. An air-intake manifold 43 is connected to a right wall portion of the cylinder head 35. The air-intake manifold 43 extends to the right of the cylinder head 35 and then curves downward. An air-intake passage 43*a* formed within the air-intake manifold 43 is coupled to the air-intake port 41 of the cylinder head 35. An exhaust manifold 44 is connected to a left wall portion of the cylinder head 35. The exhaust manifold 44 extends to the left of the cylinder head 35 and then curves obliquely downward to the left. An exhaust gas passage 44*a* formed within the exhaust manifold 44 is coupled to the exhaust port 42 of the cylinder head 35.

The cylinder head 35 is provided with a first water jacket 35*a* configured to surround four combustion chambers 40 and exhaust ports 42 corresponding to the respective cylinders. The first water jacket 35*a* opens in a connecting end face between the cylinder head 35 and the exhaust manifold 44 to form a cooling water inlet 35*b*. The exhaust manifold 44 has a double-walled structure to form a water jacket 44*b* surrounding the exhaust gas passage 44*a*. The water jacket 44*b* is coupled to the first water jacket 35*a* through the cooling water inlet 35*b* of the cylinder head 35. A first cooling water outlet 35*c* is formed to protrude from a wall portion of the cylinder head 35 to be located below the air-intake port 41, and is connected to the first water jacket 35*a*. The first water jacket 35*a* communicates with an outside through the first cooling water outlet 35*c*. The first water jacket 35*a* opens in a connecting end face between the cylinder head 35 and the cylinder block 33.

The cylinder block 33 is provided with a second water jacket 33*a* configured to surround the outer periphery of each cylinder. The second water jacket 33*a* opens in the connecting end face between the cylinder head 35 and the cylinder block 33, and is coupled to the first water jacket 35*a* through this opening. A thermostat 45 is mounted to a left wall portion of the cylinder block 33 to be located in a space between the cylinder block 33 and the exhaust manifold 44.

The first water jacket 35*a* and the second water jacket 33*a* form a part of a cooling system 60 (FIGS. 5 and 6) equipped in the personal watercraft according to the embodiment.

Figure 4:
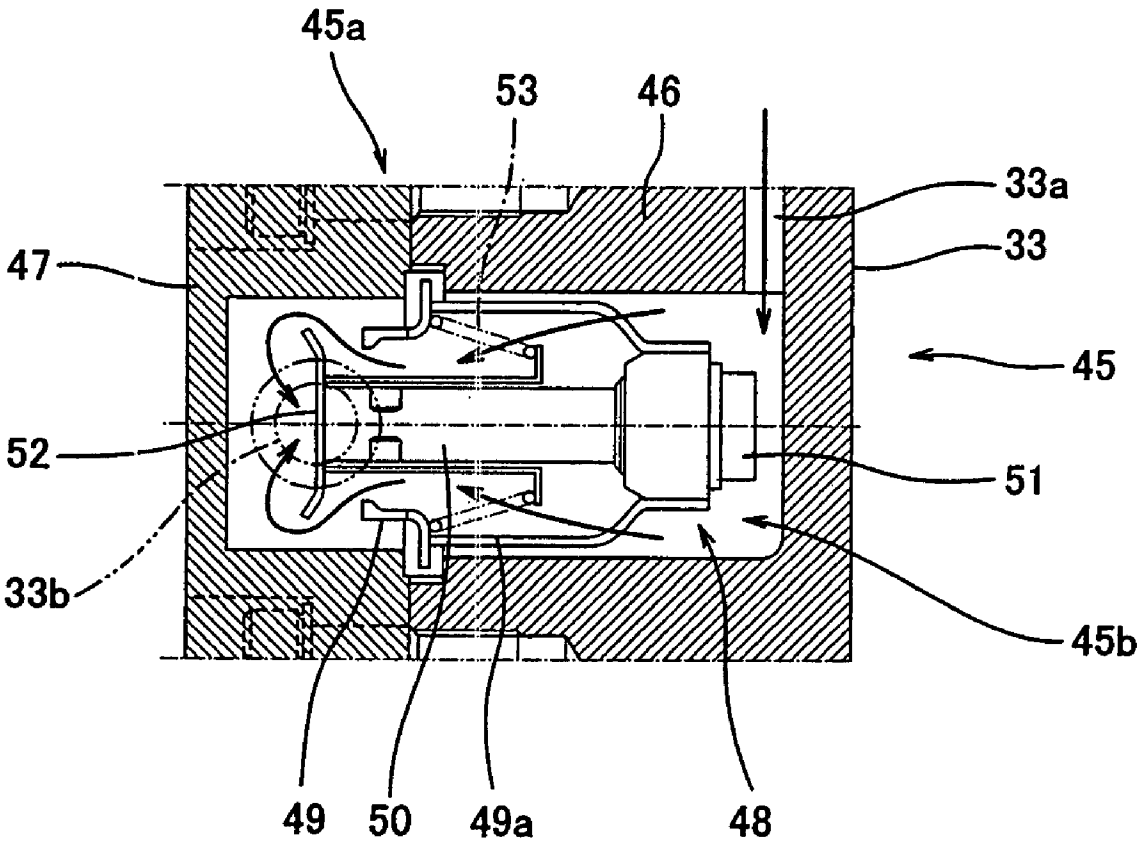
FIG. 4 is a cross-sectional view showing a construction of a thermostat of FIG. 3.

FIG. 4 is a cross-sectional view showing a construction of the thermostat 45. The thermostat 45 includes a housing 45*a* and an operating portion 45*b* housed in the housing 45*a*. A tubular portion 46 having an outer opening end is formed integrally with a wall portion of the cylinder block 33 so as to protrude outward from the wall portion of the cylinder block 33 and an inner space thereof is fluidically connected to the second water jacket 33*a*. A concave lid member 47 is provided to cover the outer opening end of the tubular portion 46. The tubular portion 46 and the concave lid member 47 form a housing 45*a* of the thermostat 45. The cooling water flows into the housing 45*a* through the second water jacket 33*a*. A second cooling water outlet 33*b* is formed in a side portion of the concave lid member 47 to allow the cooling water to flow outside therethrough. In this construction, the cooling water flows into the housing 45*a* through the second water jacket 33*a* and flows outside through the second cooling water outlet 33*b*.

A valve body 48 and a valve seat 49 are housed within the housing 45*a*. The valve seat 49 is substantially circular and is sandwiched and retained between the tubular portion 46 and the concave lid member 47. The valve body 48 has a rod-shaped plunger 50 and is supported by a support member 49*a* extending from the valve seat 49 with the plunger 50 extending within the valve seat 49. A temperature-sensitive element 51 is attached to a base end portion of the plunger 50 (upstream end portion in a flow of the cooling water) and configured to expand and contract according to the temperature of the cooling water. A water stopper plate 52 is attached to a tip end portion of the plunger 50 (downstream end portion in the flow of the cooling water). A spring 53 is mounted between the plunger 50 and the valve seat 49 and is configured to bias the valve body 48 to cause the thermostat 45 to be in a closed state.

The valve body 48 including the plunger 50, the temperature-sensitive element 51, and the water stopper plate 52 is configured such that the water stopper plate 52 is moved away from and closer to the valve seat 49 according to expansion and contraction of the temperature-sensitive element 51. As a result, the thermostat 45 opens and closes, thus controlling a flow rate of the cooling water which flows into the housing 45*a* through the second water jacket 33*a* and toward the second cooling water outlet 33*b*. Since the temperature-sensitive element 51 is positioned near the second water jacket 33*a*, the thermostat 45 operates appropriately according to the temperature of the cooling water flowing within the second water jacket 33*a*.

As shown in FIG. 3, an oil gallery 31*a* is formed in a wall portion of the crankcase 31. An oil cooler 55 and an oil filter 56 are mounted to an outer wall portion of the crankcase 31 below the air-intake manifold 43. The oil cooler 55 contains an oil passage and a cooling water passage (not shown). The oil passage of the oil cooler 55 communicates with the oil gallery 31*a* of the crankcase 31 and the oil filter 56. Therefore, the oil flowing into the oil cooler 55 through the oil gallery 31*a* is cooled by the cooling water and is then filtered by the oil filter 56. Thereafter, the cooling water is re-fed to the engine components.

Figure 5:
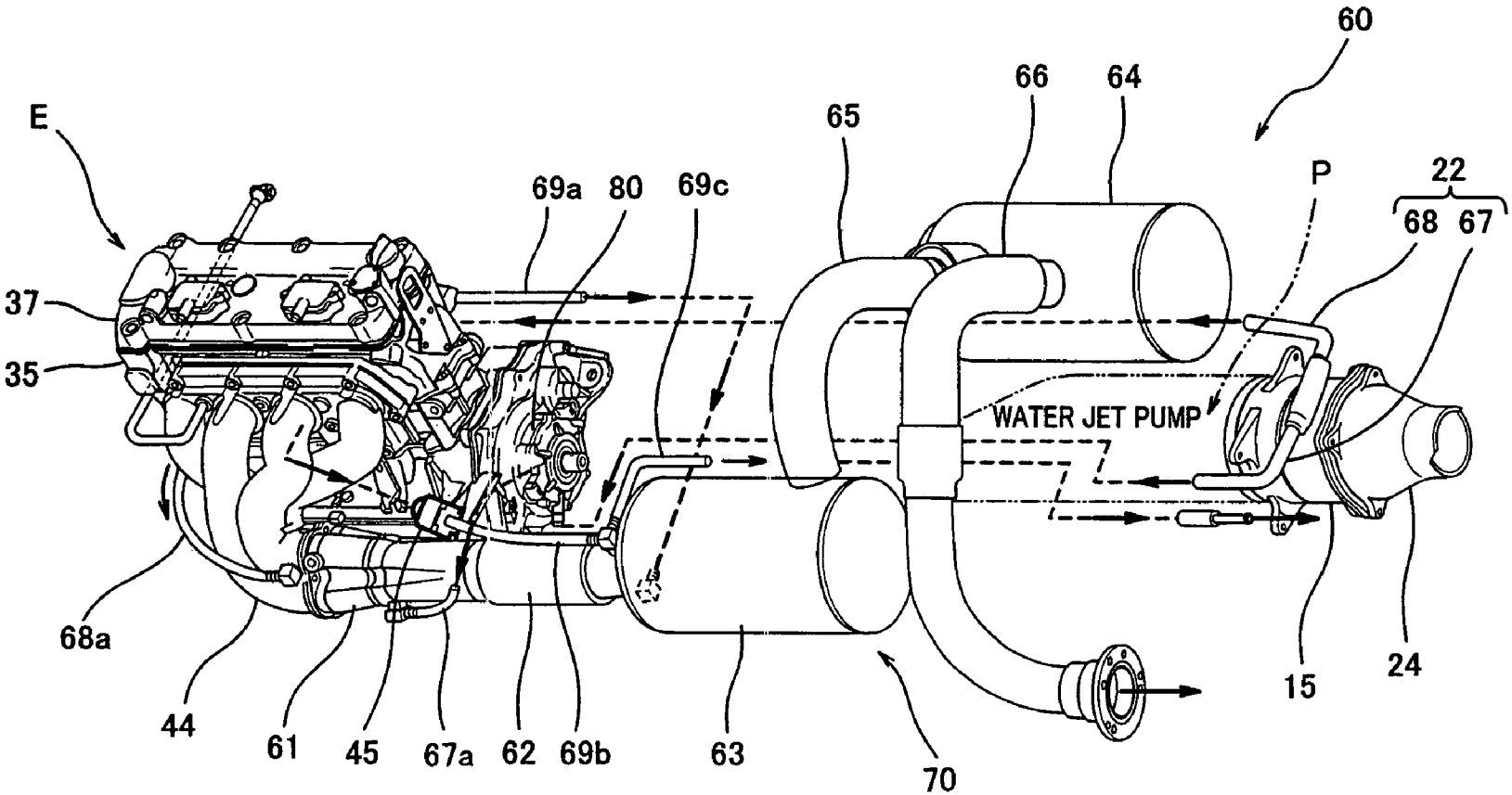
FIG. 5 is a partial exploded perspective view schematically showing a construction of a cooling system of the engine equipped in the personal watercraft of FIG. 1.

FIG. 5 is a partial exploded perspective view schematically showing a construction of the cooling system 60 of the engine E mounted in the personal watercraft of FIG. 1. The exhaust manifold 44 connected to the engine E is also connected, through a collecting pipe 61 and a rubber pipe 62, to a first cylindrical water muffler 63 mounted on the left side of the water jet pump P. In FIG. 5, the water jet pump P is represented by in two-dotted lines. A second cylindrical water muffler 64 is mounted on the right side of the water jet pump P. The first water muffler 63 communicates with the second water muffler 64 through a first connecting pipe 65. The second water muffler 64 communicates with the outside of the watercraft through a second connecting pipe 66 connected to the second water muffler 64. The first and second water mufflers 63 and 64 are configured to reduce the heat energy contained in exhaust gas flowing therein using the cooling water. The exhaust manifold 44, the collecting pipe 61, the first water muffler 63, the second water muffler 64, etc., form an exhaust pipe 70 of the personal watercraft of this embodiment. An exhaust gas emitted from the engine E is released outside the watercraft through the exhaust pipe 70.

A cooling water pipe 22 extends from an upper portion of the pump casing 15 of the water jet pump P. The cooling water pipe 22 includes a first cooling water pipe 67 and a second cooling water pipe 68 and forms the cooling system 60 including two systems. The water that has been pressurized by the water jet pump P is guided to the engine E through the first cooling water pipe 67 and the second cooling water pipe 68.

As shown in FIG. 5, the first cooling water pipe 67 extends through the left side of the water jet pump P and to a rear portion of the engine E. The water that has been pressurized by the water jet pump P is guided, through the first cooling water pipe 67, to a generator (not shown) mounted to a rear portion of the engine E, i.e., a cooling water jacket formed within a generator cover 80. The cooling water that has cooled the generator is guided to the collecting pipe 61 through a cooling water pipe 67*a* extending from the rear portion of the engine E. The collecting pipe 61 has a double-walled structure provided with a water jacket (not shown) that surrounds an exhaust gas passage. The cooling water pipe 67*a* communicates with the water jacket of the collecting pipe 61, which in turn communicates with a water jacket 44*b* (FIG. 3) formed in the exhaust manifold 44. Therefore, the cooling water drawn up through the first cooling water pipe 67 is supplied to the water jacket 44*b* of the exhaust manifold 44 through the cooling water pipe 67*a*, and further to the first water jacket 35*a* of the cylinder head 35 and the second water jacket 33*a* of the cylinder block 33.

As shown in FIG. 5, the second cooling water pipe 68 extends through the right side of the water jet pump P and to the oil cooler 55 (FIG. 3) mounted to the right wall portion of the crankcase 31, and the cooling water flowing through the second cooling water pipe 68 cools the oil inside the oil cooler 55. A cooling water pipe 68*a* extends from the oil cooler 55, through a front side of the engine E, and to the left side of the engine E. A tip end portion of the cooling water pipe 68*a* is connected to a region near a downstream end portion of the exhaust manifold 44 in a flow of the exhaust gas. In this construction, the oil cooler 55 communicates with the water jacket 44*b* of the exhaust manifold 44 through the cooling water pipe 68*a*. The cooling water drawn up through the second cooling water pipe 68 is supplied to the water jacket 44*b* of the exhaust manifold 44 through the cooling water pipe 68*a*. As should be appreciated from the above, the cooling water flowing from the first cooling water pipe 67 and the cooling water flowing from the second cooling water pipe 68 gather at the water jacket 44*b* of the exhaust manifold 44. Thereafter, the cooling water is supplied to the first water jacket 35*a* of the cylinder head 35 and then to the second water jacket 33*a* of the cylinder block 33.

As shown in FIG. 5, a cooling pipe 69*a* extends from the first cooling water outlet 35*c* provided in the right wall portion of the cylinder head 35. The cooling pipe 69*a* is connected to an upstream end portion of the first water muffler 63 in the flow of the exhaust gas and is configured to communicate with an inside of the first water muffler 63. In this construction, the cooling water flows out from the first water jacket 35*a* of the cylinder head 35 through the first cooling water outlet 35*c* and is supplied to the exhaust gas flowing within the first water muffler 63 through the cooling pipe 69*a*.

A cooling pipe 69*b* extends from the second cooling water outlet 33*b* provided in the left wall portion of the cylinder block 33. The cooling water pipe 69*b* is connected to the upstream end portion of the first water muffler 63 and configured to communicate with an inside of the first water muffler 63. A cooling pipe 69*c* extends rearward from a portion where the cooling pipe 69*b* and the first water muffler 63 are connected to each other, through the outside of the first water muffler 63, and to outside of the watercraft. In this construction, the cooling water flows out from the second water jacket 33*a* through the second cooling water outlet 33*b*, and is divided to be supplied to the exhaust gas flowing within the first water muffler 63 and to be discharged outside the watercraft through the cooling pipe 69*c*.

Figure 6:
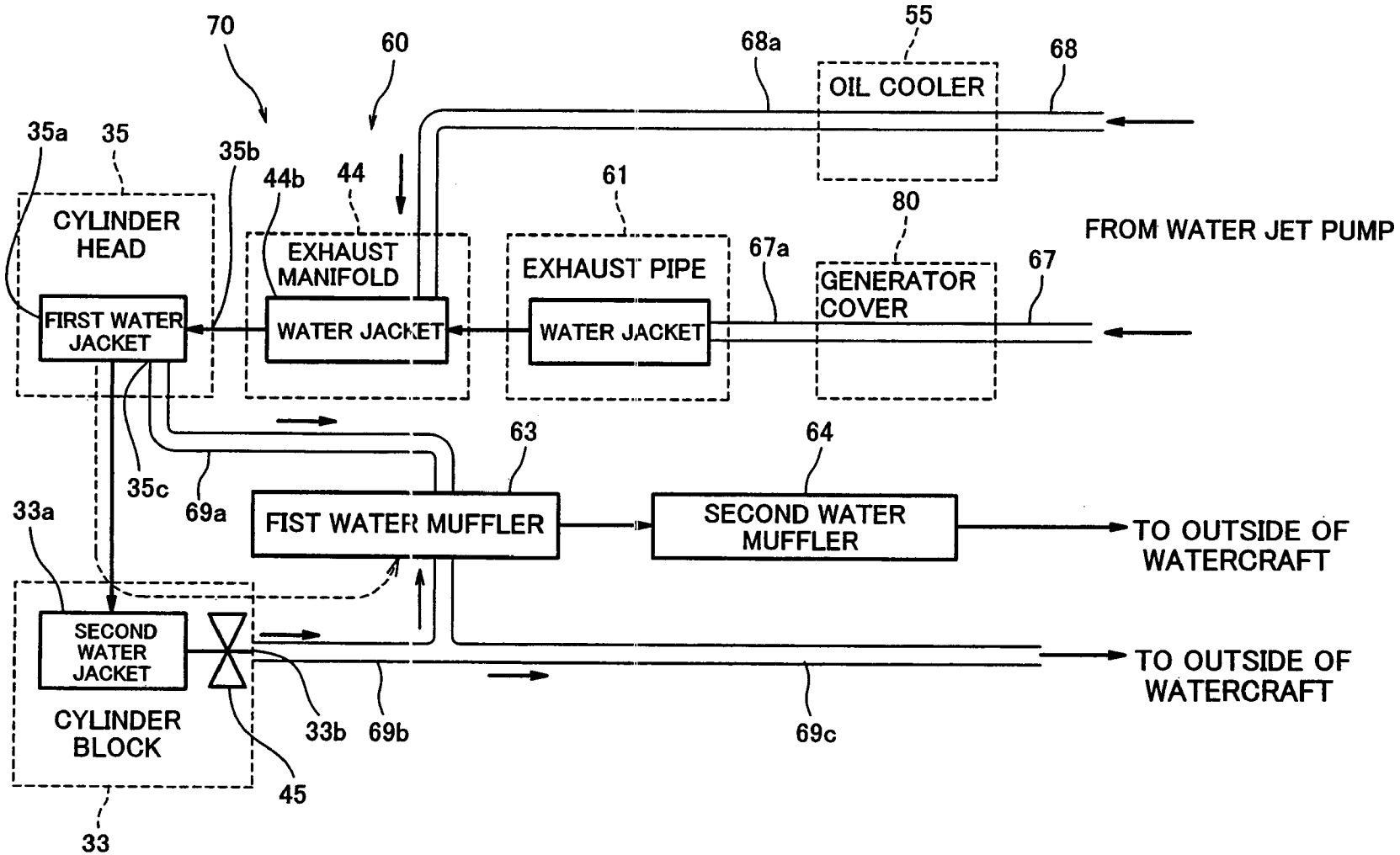
FIG. 6 is a block diagram showing a flow of cooling water in the cooling system.

The flow of the cooling water in the above constructed cooling system 60 will be described with reference to FIG. 6. As shown in FIG. 6, the cooling water is drawn up from the inside of the water jet pump P through the first cooling water pipe 67 and flows through the generator, i.e., the generator cover 80, and the collecting pipe 61 while cooling these components, and then flows into the water jacket 44*b* of the exhaust manifold 44. Meanwhile, the cooling water is drawn up from the inside of the water jet pump P through the second cooling water pipe 68 and flows through the oil cooler 55 while cooling the oil within the oil cooler 55. Then, the cooling water flows into the water jacket 44*b* of the exhaust manifold 44. That is, the cooling water from the first cooling water pipe 67 and the cooling water from the second cooling water pipe 68 gather at the water jacket 44*b* of the exhaust manifold 44. Since the cooling system 60 has two cooling water supply systems to supply the cooling water to the water jacket 44*b* of the exhaust manifold 44 as described above, the cooling water is supplied thereto even when one of these is clogged with, for example, silt, rocks, or waterborne plants, which are generally contained in sea or lake water.

The cooling water flows from the water jacket 44*b* of the exhaust manifold 44 into the first water jacket 35*a* of the cylinder head 35 through the cooling water inlet 35*b*. The cooling water within the first water jacket 35*a* is supplied to the exhaust gas flowing within the first water muffler 63 through the first cooling water outlet 35*c*. In addition, the cooling water within the first water jacket 35*a* is supplied to the second water jacket 33*a* of the cylinder block 33. Since the cooling water flowing into the second water jacket 33*a* increases in temperature by heat exchange with the exhaust manifold 44 and the cylinder head 35, excess cooling of the cylinder block 33 is inhibited.

The cooling water within the second water jacket 33*a* flows out through the thermostat 45 and the second cooling water outlet 33*b*. Some of the cooling water is supplied to the exhaust gas flowing within the first water muffler 63 through the cooling pipe 69*b* and the other is discharged outside the watercraft through the cooling pipes 69*b* and 69*c*.

The cooling water is drawn up from the inside of the water jet pump P through the first cooling water pipe 67 and the second cooling water pipe 68 according to an engine speed of the engine E. In addition, heat generation amount in the engine E increases substantially with an increase in the engine speed of the engine E. Heat generated in the engine E transfers to the cooling water supplied according to the engine speed. In this manner, the engine E is properly cooled. However, a variation rate of the heat generation amount according to the engine speed of the engine E does not always correspond with the variation rate of the flow rate of the cooling water according to the engine speed of the engine E. In that case, if the engine E continues a low speed operation, for example, idling for a long time period, then the cylinder block 33 may be cooled excessively.

In the personal watercraft of this embodiment, the thermostat 45 operates based on the temperature of the cooling water flowing out from the second water jacket 33*a* before the cylinder block 33 is cooled excessively. Specifically, the temperature-sensitive element 51 (FIG. 4) of the valve body 48 which is equipped in the thermostat 45 is configured to contract to close the thermostat 45 at a predetermined temperature at which excess cooling of the cylinder block 33 can be inhibited. When at or below the predetermined temperature, the thermostat 45 is in a closed state. In the closed state, the thermostat 45 cuts off a path of the cooling water (indicated by a broken line arrow) flowing from the first water jacket 35*a*, through the second water jacket 33*a* and the thermostat 45, and to the first water muffler 63, thereby inhibiting excess cooling of the cylinder block 33. Thereafter, when the engine E rotates at a high speed and heat generation amount thereby increases to heat up the cylinder block 33 to an appropriate temperature, the thermostat 45 transitions to an opens state. Thus, the cylinder block 33 is appropriately cooled.

In the cooling system 60 of this embodiment, even when the thermostat 45 is in the closed state to reduce the flow rate of the cooling water flowing through the second water jacket 33*a*, the cooling water is caused to flow within the first water jacket 35*a* to cool the cylinder head 35. As a result, excess cooling of the cylinder block 33 is inhibited while appropriately cooling the cylinder head 35 that tends to elevate in temperature.

Since the cooling system 60 of this embodiment employs the open-looped cooling system, air may sometimes enters the cooling water when the cooling water is drawn from the inside of the water jet pump P. In that case, the temperature-sensitive element 51 is likely to expand and contract incorrectly, due to the air contained in the cooling water, making it difficult for the thermostat 45 to operate effectively. In the cooling system 60, however, since the thermostat 45 is positioned in the vicinity of the second cooling water outlet 33*b* located lower than the first cooling water outlet 35*c*, the air contained in the cooling water tends to move upward in the cooling water toward the first cooling water outlet 35*c*, and the air is not substantially contained in the cooling water flowing toward the second cooling water outlet 33*b*. Therefore, the thermostat 45 operates effectively.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A cooling system of an engine for a personal watercraft, the cooling system being an open-looped cooling system configured to take in water from outside the watercraft for use as cooling water to directly cool the engine, the cooling system comprising:

a cylinder head including a first water jacket through which the cooling water flows, a cooling water inlet through which the first water jacket communicates with outside, and a first cooling water outlet through which the first water jacket communicates with outside;

a cylinder block including a second water jacket through which the cooling water within the first water jacket flows, the second water jacket being configured to communicate with the first water jacket, and a second cooling water outlet through which the second water jacket communicates with outside;

a thermostat configured to control a flow rate of the cooling water flowing out from the second cooling water outlet of the cylinder block based on a temperature of the cooling water;

an exhaust pipe that has a water jacket through which the cooling water flows and is connected to the cylinder head; and two cooling water supply systems configured to supply the cooling water to the water jacket of the exhaust pipe from outside of the watercraft, the two cooling water supply systems respectively having cooling water pipes through which the cooling water is supplied;

wherein the cooling water inlet of the cylinder head is configured to open in a connecting end face between the cylinder head and the exhaust pipe, and is configured to communicate with the water jacket of the exhaust pipe through the connecting end face.

2. The cooling system of an engine for a personal watercraft according to claim 1, wherein the thermostat is mounted to the cylinder block provided with the second cooling water outlet such that the cooling water within the second water jacket flows out through the thermostat and the second cooling outlet.

3. The cooling system according to claim 2, wherein the thermostat includes a housing and an operating portion housed in the housing;

wherein the housing includes a tubular portion having an outer opening end and configured to be integral with a wall portion of the cylinder block such that an inside of the tubular portion communicates with the second water jacket of the cylinder block; the cooling system further comprising:

a lid portion configured to cover the outer opening end of the tubular portion.

4. The cooling system according to claim 3, wherein the lid portion is provided with the second cooling water outlet of the cylinder block.

5. The cooling system of an engine for a personal watercraft according to claim 2, wherein the exhaust pipe includes a water muffler to which the cooling water is supplied to reduce an energy of an exhaust gas flowing therein, wherein the second cooling water outlet is provided in a wall portion of the cylinder block which is located on an exhaust port side of the engine, the cooling system further comprising:

a cooling water pipe constructed such that one end portion thereof is connected to the second cooling water outlet of the cylinder block and an opposite end portion thereof is connected to a region of the exhaust pipe which is located upstream of the water muffler in a flow of the exhaust gas and is configured to communicate with an exhaust gas passage formed within the exhaust pipe.

6. The cooling system of an engine for a personal watercraft according to claim 5, further comprising:

another cooling water pipe constructed such that one end portion thereof is connected to the first cooling water outlet of the cylinder head and an opposite end portion thereof is connected to the region of the exhaust pipe and is configured to communicate with the exhaust gas passage of the exhaust pipe.

* * * * *